US011131304B2

(12) United States Patent
Kitaguchi et al.

(10) Patent No.: US 11,131,304 B2
(45) Date of Patent: Sep. 28, 2021

(54) SCROLL COMPRESSOR AND METHOD FOR PRODUCING SAME

(71) Applicant: MITSUBISHI HEAVY INDUSTRIES, LTD., Tokyo (JP)

(72) Inventors: Keita Kitaguchi, Tokyo (JP); Takahide Ito, Tokyo (JP); Makoto Takeuchi, Tokyo (JP); Takuma Yamashita, Tokyo (JP); Hirofumi Hirata, Kiyosu (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 213 days.

(21) Appl. No.: 16/463,926

(22) PCT Filed: Nov. 29, 2017

(86) PCT No.: PCT/JP2017/042778
§ 371 (c)(1),
(2) Date: May 24, 2019

(87) PCT Pub. No.: WO2018/101316
PCT Pub. Date: Jun. 7, 2018

(65) Prior Publication Data

US 2020/0072218 A1 Mar. 5, 2020

(30) Foreign Application Priority Data

Nov. 30, 2016 (JP) ..... JP2016-233036

(51) Int. Cl.
*F04C 18/02* (2006.01)
*F04C 29/00* (2006.01)

(52) U.S. Cl.
CPC ..... *F04C 18/0215* (2013.01); *F04C 29/0057* (2013.01); *F04C 29/0021* (2013.01);
(Continued)

(58) Field of Classification Search
CPC ..... F04C 2240/50; F04C 2240/51; F04C 2240/52; F04C 2240/56; F04C 2240/805;
(Continued)

(56) References Cited

U.S. PATENT DOCUMENTS 5,855,473 A 1/1999 Liepert
6,273,616 B1 8/2001 Pflug
(Continued)

FOREIGN PATENT DOCUMENTS

CN 1383472 12/2002
CN 1436935 8/2003
(Continued)

OTHER PUBLICATIONS

International Search Report dated Feb. 6, 2018 in International (PCT) Application No. PCT/JP2017/042778 with English translation.

(Continued)

*Primary Examiner* — Mark A Laurenzi
*Assistant Examiner* — Xiaoting Hu
(74) *Attorney, Agent, or Firm* — Wenderoth, Lind & Ponack, L.L.P.

(57) ABSTRACT

A scroll compressor includes a drive bush disposed in one end portion in an axial direction of a main shaft, and configured to be eccentrically rotated in accordance with rotation of the main shaft, a pair of angular bearings arranged back-to-back, and respectively clearance-fitted to an outside of the drive bush, a compression unit that has a boss portion which protrudes from an end plate of a movable scroll and in which the angular bearings are interference-fitted to an inner peripheral surface of the boss portion, and a preload application unit configured to apply a preload to the angular bearings in a direction in which the angular bearings are configured to move toward each other.

6 Claims, 4 Drawing Sheets

(52) U.S. Cl.
CPC .... *F04C 2230/602* (2013.01); *F04C 2240/50* (2013.01); *F04C 2240/805* (2013.01); *F04C 2240/807* (2013.01)

(58) Field of Classification Search
CPC ..... F04C 18/02–0292; F04C 2230/602; F04C 29/0057; F04C 29/0021; F04C 2240/807
See application file for complete search history.

(56) References Cited

U.S. PATENT DOCUMENTS

| | | | | |
|---|---|---|---|---|
| 8,591,210 | B2 * | 11/2013 | Collie | F01C 1/0215 418/55.5 |
| 2002/0114719 | A1 | 8/2002 | Itoh et al. | |
| 2003/0147763 | A1 | 8/2003 | Sakuda et al. | |
| 2011/0123324 | A1 | 5/2011 | Hwang et al. | |
| 2015/0152866 | A1 * | 6/2015 | Forni | F04C 18/0215 418/55.1 |
| 2015/0184656 | A1 * | 7/2015 | Forni | F04C 29/0021 418/55.6 |

FOREIGN PATENT DOCUMENTS

| | | |
|---|---|---|
| CN | 104747445 | 7/2015 |
| EP | 0 520 487 | 12/1992 |
| GB | 2520777 | 6/2015 |
| GB | 2521682 | 7/2015 |
| JP | 58-010586 | 2/1983 |
| JP | 2930269 | 8/1999 |
| JP | 2000-192968 | 7/2000 |
| JP | 2003-232288 | 8/2003 |
| JP | 2004-003410 | 1/2004 |
| JP | 2011-111955 | 6/2011 |

OTHER PUBLICATIONS

Written Opinion of the International Searching Authority dated Feb. 6, 2018 in International (PCT) Application No. PCT/JP2017/042778 with English translation.

* cited by examiner

SCROLL COMPRESSOR AND METHOD FOR PRODUCING SAME

CROSS-REFERENCE TO RELATED APPLICATION

Priority is claimed from Japanese Patent Application No. 2016-233036, filed on Nov. 30, 2016, the content of which is incorporated herein by reference.

TECHNICAL FIELD

The present invention relates to a scroll compressor and a method for producing the same.

BACKGROUND ART

In order to reduce a size, a weight, and a cost of a scroll compressor, a shell-type needle bearing whose size and diameter can be reduced and whose cost can be expected to be reduced has been used as follows. In the shell-type needle bearing, a bearing for rotatably supporting a crankshaft with respect to a housing or a bearing for rotatably coupling a crankpin portion of the crankshaft and a turning scroll with each other is replaced with a ball bearing having high rigidity and dimensional accuracy (for example, PTLS 1 to 4).

On the other hand, in the shell-type needle bearing is configured to include an outer ring formed of a thin plate material, a needle roller serving as a rolling element, and a cage for holding the needle roller. However, compared to a solid-type needle bearing, a thickness of the thin plate material configuring the outer ring is thinner as much as approximately 1 mm, for example. Accordingly, the rigidity and the dimensional accuracy of the bearing alone are not high at all, and a tolerance of an outer diameter is not generally displayed. The shell-type needle bearing is press-fitted into a hole on a bearing boss portion side having sufficient rigidity and dimensional accuracy. Accuracy of a raceway surface (inscribed circle of the needle roller) is maintained by following accuracy of the hole. In this manner, the shell-type needle bearing is designed to achieve original performance.

In a case where a single-row deep groove ball bearing is adopted as the bearing, it is possible to support an axial load as well as a radial load acting on the turning scroll. However, in this case, the single-row deep groove ball bearing supports a moment, and thus, the turning scroll is inclined as much as bearing clearance and elastic deformation. The inclined turning scroll obliquely comes into contact with the fixed scroll. Consequently, a clearance increases, thereby degrading compression efficiency of a fluid introduced into a compression chamber.

In addition, in a case where a four-point contact ball bearing or a double-row angular bearing is adopted as the bearing, it is possible to support the axial load and the moment as well as the radial load acting on the turning scroll. However, the four-point contact ball bearing has a special structure. Accordingly, in a case of using the four-point contact ball bearing, the cost is extremely high. Furthermore, the four-point contact ball bearing cannot support a large moment, since an axial contact distance thereof is short. In addition, the double-row angular bearing is less likely to suppress shaft inclination caused by a preload. Similarly to a case where the moment is supported by the single-row deep groove ball bearing, the turning scroll is inclined as much as the bearing clearance and the elastic deformation, thereby degrading the compression efficiency.

In addition, in a case where a pair of angular bearings arranged back to-back is adopted as the bearing, a spacer for a fixed position preload is interposed between outer rings of the respective bearings, and inner ring sides are press-fitted (or shrink-fitted). In this manner, a preload can be applied. Thereafter, a scroll can be assembled by inserting the outer ring into a turning scroll boss in a clearance-fitting manner. However, in this case, the scroll during an operation is movable in an axial direction. Therefore, depending on the center of gravity of the scroll, the scroll may float in a direction away from the bearing in some cases. As a result, a problem arises in that the scroll may be damaged due to contact of a scroll tip. Furthermore, in a case where the outer ring sides are also press-fitted (shrink-fitted), the shaft side and the turning scroll are less likely to be disassembled, thereby impairing maintenance workability.

In a case where a pair of angular bearings arranged face-to-face is adopted, the spacer for the fixed position preload is interposed between the inner rings of the respective bearings, and the inner ring sides are press-fitted (or shrink-fitted). Furthermore, the outer ring sides are pressed with a pressing metal fitting to be attached to the turning scroll. In this manner, the preload can be applied. In this case, the scroll during the operation does not move in the axial direction. In addition, during maintenance work, disassembly work is easy. However, according to the face-to-face arrangement of the angular bearings, the distance between the contact points is shortened, and a loadable moment decreases. Therefore, it is necessary to use a relatively large-sized bearing. Consequently, the size and the weight are less likely to be reduced. Moreover, there is a problem of increasing cost.

In a case where a relationship among the scroll, a shaft boss, and a bush is reversed so that the bush is installed on the scroll side, the pair of angular bearings is arranged back-to-back, the spacer for the fixed position preload is interposed between the outer ring sides, and the inner ring sides are press-fitted (or shrink-fitted). In this case, the preload can be applied. However, in a case where the bush on the scroll side is clearance-fitted to the boss on main shaft side, a problem arises in that the scroll may float. In a case of the press-fitting (shrink-fitting), a problem arises in that the maintenance workability may be impaired.

CITATION LIST

Patent Literature

[PTL 1] Japanese Unexamined Patent Application, First Publication No. S58-10586

[PTL 2] Japanese Patent (Granted) Publication No. 2930269

[PTL 3] Japanese Unexamined Patent Application, First Publication No. 2000-192968

[PTL 4] Japanese Unexamined Patent Application, First Publication No. 2003-232288

SUMMARY OF INVENTION

Technical Problem

The present invention provides a scroll compressor which facilitates assembly and maintenance work by more strongly applying a preload to an angular bearing for supporting radial components of a gas load and a centrifugal force.

Solution to Problem

According to an aspect of the present invention, there is provided a scroll compressor including a main shaft rotated around an axis, a drive bush disposed in one end portion in an axial direction of the main shaft, and eccentrically rotated in accordance with rotation of the main shaft, a pair of angular bearings arranged back-to-back, and respectively clearance-fitted to an outside of the drive bush, a compression unit that has a fixed scroll and a movable scroll, and that has a boss portion which protrudes from an end plate of the movable scroll and in which the pair of angular bearings are interference-fitted to an inner peripheral surface of the boss portion, and a preload application unit that is configured to apply a preload to the pair of angular bearings in a direction in which the pair of angular bearings moves close to each other.

In a configuration of the above-described scroll compressor, the preload application unit may have a preload metal fitting which is clearance-fitted to an inside of one of the pair of angular bearings and which has a first through-hole at a position overlapping the drive bush, and a preload bolt which is fitted into the first through-hole. A side wall of the drive bush may have a protruding portion which supports the other of the pair of angular bearings.

In a configuration of the above-described scroll compressor, the end plate of the movable scroll may have a second through-hole at a position overlapping the first through-hole, and a sealing bolt may be fitted into the second through-hole. A wrap of the fixed scroll may have a cutout portion which is as large as a protruding portion of the fitted sealing bolt, on an end plate side in an end portion located at a center of the whole wrap.

In a configuration of the above-described scroll compressor, the fixed scroll and the movable scroll may respectively have two pairs of wraps. The end plate of the movable scroll may have a third through-hole at a position which does not overlap the wrap of the fixed scroll, and a sealing bolt may be fitted into the third through-hole.

According to another aspect of the present invention, there is provided a method for producing the scroll compressor having the above-described configuration. The method sequentially includes a step of clearance-fitting the preload application unit to an inside of one of the pair of angular bearings, a step of interference-fitting the one of the pair of angular bearings into the boss portion of the movable scroll, a step of interference-fitting the other of the pair of angular bearings to a position closer to an opening end of the boss portion than the one of the pair of angular bearings, inside the boss portion, and a step of clearance-fitting the drive bush disposed in one end portion in the axial direction of the main shaft to the inside of one of the pair of angular bearings and the other of the pair of angular bearings.

Advantageous Effects of Invention

The scroll compressor according to the present invention includes the pair of angular bearings as drive bearings to be attached to the main shaft, and further includes the preload application unit that applies the preload in a direction in which both of these move close to each other, that is, in a direction of the main shaft. The angular bearings fixed by the preload application unit are interference-fitted into the boss portion of the scroll. Therefore, in the scroll compressor according to the present invention, when the scroll compressor is operated, it is possible to prevent the scroll from floating in the direction of the main shaft and being separated from the angular bearings.

In addition, in the scroll compressor according to the present invention, an inner ring side of the annular bearings is not press-fitted to the drive bush. Therefore, the scroll compressor according to the present invention can be disassembled in such a manner that the preload application unit adjusts the preload, thereby achieving a configuration which facilitates assembly and maintenance work.

DESCRIPTION OF EMBODIMENTS

Figure 1:
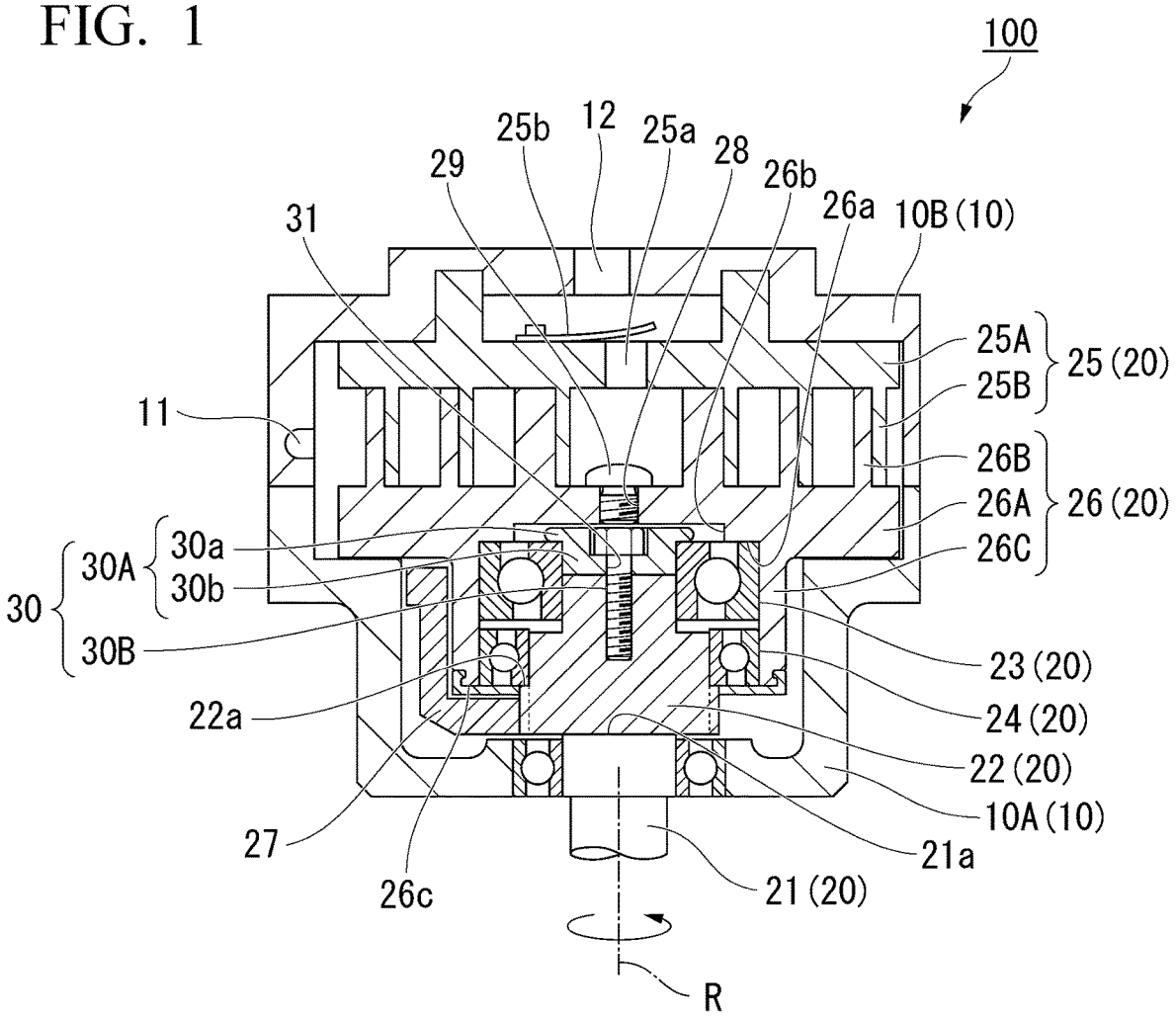
FIG. 1 is a sectional view of a scroll compressor according to a first embodiment of the present invention.

Hereinafter, a scroll compressor according to an embodiment to which the present invention is applied and a method for producing the same will be described in detail with reference to the drawings. In the drawings used in the following description, in order to facilitate understanding of characteristics, characteristic portions may be appropriately enlarged and illustrated in some cases. A dimensional ratio of each configuration element is not necessarily the same as an actual dimensional ratio. In addition, a material and a dimension exemplified in the following description are merely examples, and the present invention is not limited thereto. The present invention can be appropriately modified and embodied within the scope not modifying the gist of the present invention.

First Embodiment

[Configuration of Scroll Compressor]

FIG. 1 is a sectional view schematically illustrating a configuration of a scroll compressor 100 according to a first embodiment of the present invention. As illustrated in FIG. 1, the scroll compressor 100 includes a housing 10 configuring an outer shell, a compression unit (scroll compressor main body) 20 disposed inside the housing 10, a drive unit (not illustrated) that drives the compression unit 20, and a preload application unit 30 that applies a preload to a bearing configuring the compression unit 20. The drive unit may be disposed outside the housing 10. In addition, the scroll compressor 100 includes a structure (for example, a pin ring or an Oldham's mechanism) (not illustrated) provided with a general anti-rotation mechanism for maintaining a posture thereof.

The compression unit 20 has a main shaft (rotary shaft) 21 rotated around an axis R, a drive bush 22 eccentrically rotated in accordance with rotation of the main shaft 21, a pair of angular bearings (angular ball bearings) 23 and 24 clearance-fitted to an outside of the drive bush 22, and a compression mechanism having a pair of fixed scrolls 25 and movable scrolls (turning scrolls) 26.

The fixed scroll 25 has an end plate 25A and a spiral wrap 25B erected on one main surface of the end plate 25A. The movable scroll 26 has an end plate 26A, a spiral wrap 26B erected on one main surface of the end plate 26A, and a boss portion 26C protruding from the other main surface of the end plate 26A.

The fixed scroll 25 and the movable scroll 26 are assembled to each other so that the spiral wraps 25B and 26B mesh with each other in a state where respective phases are shifted as much as 180 degrees. A slight clearance (several tens to hundreds of microns) having room temperature along a height of the wrap is disposed in each portion among a tip of the spiral wrap 25B, the end plate 26A, a tip of the spiral wrap 26B, and the end plate 25A. According to this configuration, a compression chamber can be formed symmetrically with respect to the center of the scroll, and the movable scroll 26 can smoothly turn around the fixed scroll 25.

The main shaft 21 has a cylindrical shape centered on the axis R. The main shaft 21 is rotatably supported inside the housing 10.

The drive bush 22 is connected to one end portion 21*a* in a direction of the axis R of the main shaft 21. A balance weight 27 is integrally formed in the drive bush 22 so as to remove an unbalanced load generated by driving and turning the movable scroll 26. The balance weight 27 is configured to be turned along with the driving and turning of the movable scroll 26.

The pair of angular bearings 23 and 24 is arranged back-to-back with each another. In the pair of angular bearings 23 and 24, a distance serving as a point of action in the direction of the axis R is long, and load capacity of a moment load is increased. An outer ring side of the angular bearings 23 and 24 is interference-fitted (press-fitted or shrink-fitted) to an inner peripheral surface of the boss portion 26C of the movable scroll.

The preload application unit 30 is means for applying the preload to the angular bearings 23 and 24 in a direction in which both of these move close to each other. Specifically, the preload application unit 30 is configured to include members such as a preload metal fitting 30A and a preload bolt 30B.

The preload metal fitting 30A is a member configured to include a flat plate-shaped portion 30*a* and a projection-shaped portion 30*b* disposed at the center of one main surface thereof. In the flat plate-shaped portion 30*a*, an area of one main surface is larger than an area of a circle surrounded by one inner ring (one farther from the main shaft 21) of the pair of angular bearings 23 and 24. The area of the flat plate-shaped portion 30*a* according to the present embodiment is larger than the area of the circle surrounded by the inner ring of the angular bearing 23.

The projection-shaped portion 30*b* of the preload metal fitting is clearance-fitted into the angular bearing 23. It is preferable that an end portion region having no projection-shaped portion 30*b* is in contact with the inner ring of the angular bearing 23 within one main surface of the flat plate-shaped portion 30*a*. In this manner, the angular bearing 23 is fixed by the flat plate-shaped portion 30*a* and the projection-shaped portion 30*b*.

The projection-shaped portion 30*b* of the preload metal fitting has a first through-hole 31 at a position overlapping the drive bush 22. The preload bolt 30B is fitted into the first through-hole 31.

A side wall of the drive bush 22 has a protruding portion 22*a* which supports the other (one closer to the main shaft 21) of the pair of angular bearings 23 and 24. The side wall of the drive bush 22 according to the present embodiment has the protruding portion 22*a* which supports the angular bearing 24. If an outer ring diameter of the angular bearing is set to $D_o$ and an inner ring diameter is set to $D_i$, it is preferable that the protruding portion 22*a* protrudes 1 mm or longer from the side wall of the drive bush 22 and protrudes within a range equal to or shorter than a numerical value calculated by $\{(D_o-D_i)/2\}\div 3$. Equation $\{(D_o-D_i)/2/$is used for calculating a diameter of one cross section of the angular bearing. If respective widths of the inner ring, the outer ring, and an interposed space thereof in the cross section are substantially equal to each other, Equation $\{(D_o-D_i)/2\}\div 3$ is used for calculating the inner ring width obtained by equally dividing the diameter of this cross section into three. That is, it is preferable that a protruding length of the protruding portion 22*a* is 1 mm or longer, and equal to or shorter than the inner ring width of the angular bearing.

The end portion of the preload metal fitting 30A is supported by the inner ring of the angular bearing 23, and the inner ring of the angular bearing 24 is supported by the protruding portion 22*a* of the drive bush. From a viewpoint of stability, in the preload metal fitting 30A, it is preferable that a portion of 1 mm or longer from the end portion is supported by the inner ring of the angular bearing 23. In addition, in the inner ring of the angular bearing 24, it is preferable that a portion of 1 mm or longer from the end portion is supported by the protruding portion 22*a* of the drive bush.

In order to adjust a fastening tool of the preload bolt 30B to fasten the preload metal fitting 30A when maintenance work is carried out for the scroll compressor 100, a second through-hole 28 for allowing insertion of the tool is disposed at a position overlapping the first through-hole 31 in the end plate 26A of the movable scroll.

The preload metal fitting 30A is more strongly fastened using the preload bolt 30B, and the preload bolt 30B is more deeply inserted into the first through-hole 31 from the upper side (scrolling side). Accordingly, the portion protruding from the lower side (main shaft side) can be fastened to the drive bush 22. In this manner, the angular bearings 23 and 24 are pressurized in the direction in which both of these move close to each other, in a state where the angular bearings 23 and 24 are interposed between the preload metal fitting 30A and the protruding portion 22*a* of the side wall of the drive bush 22.

When the scroll compressor 100 is operated, the sealing bolt 29 is fitted into the second through-hole 28 as illustrated in FIG. 1. In this manner, the second through-hole 28 can be brought into a sealed state where compressed gas does not leak.

In addition, when the scroll compressor 100 is initially assembled or disassembled for maintenance work, the second through-hole 28 is brought into an open state by detaching the sealing bolt 29. In this manner, the second through-hole 28 can adjust a fastening degree of the preload bolt by using the tool by way of the inside of the second through-hole 28.

As illustrated in FIG. 1, a bottom surface 26*a* of the boss portion is supported by the angular bearing 23. In this manner, the outer ring of the angular bearing 23 and 24 can be pressurized, thereby improving stability. In this case, a thicker portion of the flat plate-shaped portion 30*a* of the preload metal fitting protrudes from a surface supported by the angular bearing 23. Therefore, the bottom portion 26*a* of the boss portion has a recess portion 26*b* which accommodates the protruding portion.

The compression unit 20 is connected to the drive unit via the main shaft 21 extending along the axis R. That is, rotational energy generated by the drive unit is immediately transmitted to the compression unit 20 through the main shaft 21. The compression unit 20 compresses a working fluid by using the rotational energy, and discharges the working fluid outward in a high pressure state. The high pressure working fluid is used as a refrigerant in an air conditioner, for example. For example, the working fluid includes general gas, minute oil, and gas containing a liquid. However, the working fluid is not particularly limited thereto.

The housing 10 is configured so that a front housing 10A and a rear housing 10B are integrally fastened and fixed to each other by using a bolt. In the front housing 10A and the rear housing 10B, fastening flanges are integrally formed at an equal interval in a plurality of circumferential locations (for example, 4 locations). The flanges are fastened to each other by using the bolt, thereby causing the front housing 10A and the rear housing 10B to be integrally coupled with each other.

The front housing 10A mainly covers a portion where the drive bush 22 and the angular bearings 23 and 24 are arranged. The rear housing 10B mainly covers a portion where two scrolls are arranged. The rear housing 10B has an introduction port 11 and a discharge port 12. The introduction port 11 introduces the working fluid from the outside. The discharge port 12 discharges the gas brought into a high pressure state after being compressed by the compression unit 20 outward by way of the through-hole 25*a* disposed in the end plate 25A of the fixed scroll. An opening portion of the through-hole 25*a* has a reed valve 25*b* through which only the gas compressed to reach a predetermined pressure is allowed to pass.

[Method of Producing Scroll Compressor]

FIGS. 2 to 5 are views for describing a method for producing (method for assembling) the above-described scroll compressor.

Figure 2:
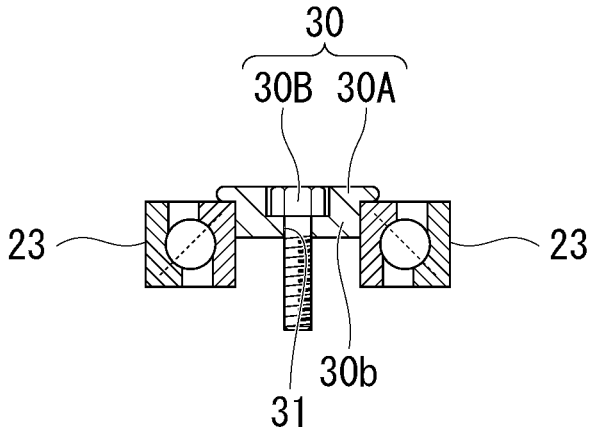
FIG. 2 is a sectional view in a producing process (first step) of the scroll compressor according to the first embodiment of the present invention.

First, as illustrated in FIG. 2, the preload application unit 30 (specifically, a projection-shaped portion 30*b* of the preload metal fitting configuring the preload application unit 30) is clearance-fitted to an inside (inner ring side) of one (here, the angular bearing 23) of the pair of angular bearings 23 and 24 (first step). At this time, the preload bolt 30 B is fitted into the first through-hole 31. As the angular bearing 23, the following one is selected. In the angular bearing 23, a straight line (indicated by a broken line) connecting contact points of a ball configuring the bearing, the inner ring, and the outer ring to each other is inclined to the application unit 30 side (upper side in FIG. 2) so that the angular bearing 23 and the angular bearing 24 to be interference-fitted in the subsequent step are arranged back-to-back.

Figure 3:
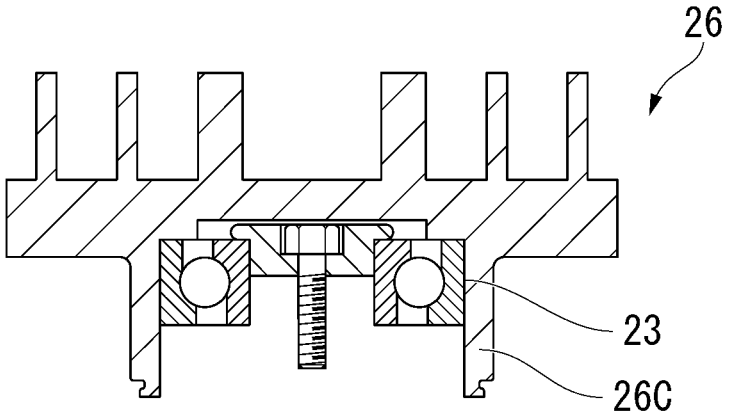
FIG. 3 is a sectional view in a producing process (second step) of the scroll compressor according to the first embodiment of the present invention.

Next, as illustrated in FIG. 3, the angular bearing 23 is interference-fitted (press-fitted) into the boss portion 26C of the movable scroll 26 (second step). From a viewpoint of stability, it is preferable that an interference-fitting position of the angular bearing 23 is closer to a bottom portion of the boss portion.

Figure 4:
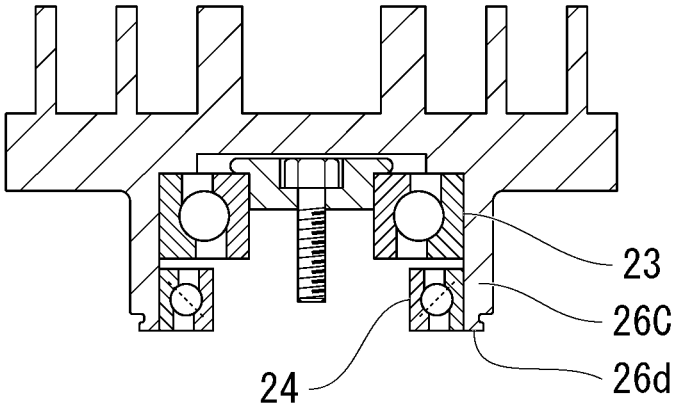
FIG. 4 is a sectional view in a producing process (third step) of the scroll compressor according to the first embodiment of the present invention.

Next, as illustrated in FIG. 4, another angular bearing 24 is interference-fitted into the boss portion 26C so as to be adjacent to the angular bearing 23 at a position closer to an opening end 26*d* of the boss portion than the angular bearing 23 (third step). As the angular bearing 24, the following one is selected. In the angular bearing 24, a straight line (indicated by a broken line) connecting contact points of a ball configuring the bearing, the inner ring, and the outer ring to each other is inclined to a side opposite to the application unit 30 side (lower side in FIG. 4) so that the angular bearing 23 and the angular bearing 24 are arranged back-to-back.

Figure 5:
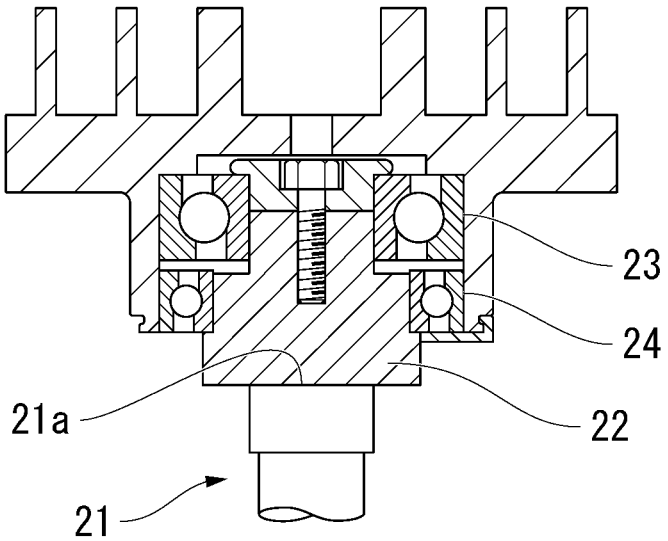
FIG. 5 is a sectional view in a producing process (fourth step) of the scroll compressor according to the first embodiment of the present invention.

Next, as illustrated in FIG. 5, the drive bush 22 disposed in one end portion 21*a* in the axial direction of the main shaft 21 is clearance-fitted into the angular bearing 23 and the angular bearing 24 (fourth step). As the drive bush 22, the following one is used. The drive bush 22 has a shape in contact with any inner ring of the angular bearings 23 and 24 when being clearance-fitted.

As described above, the scroll compressor 100 according to the present embodiment includes the pair of angular bearings 23 and 24 as drive bearings to be attached to the main shaft 21, and further, includes the preload application unit 30 that applies the preload in the direction in which both of these move close to each other, that is, the direction of the main shaft 21. The angular bearing 23 and 24 fixed by the preload application unit 30 is interference-fitted into the boss portion 26C of the movable scroll. Therefore, in the scroll compressor 100 according to the present embodiment, when the scroll compressor 100 is operated, the movable scroll 26 can be prevented from floating in the direction of the main shaft 21 and being separated from the angular bearings 23 and 24.

In addition, in the scroll compressor 100 according to the present embodiment, the inner ring side of the angular bearings 23 and 24 is not press-fitted to the drive bush 22. Therefore, the scroll compressor 100 according to the present embodiment can be disassembled only by causing the preload application unit to adjust the preload, thereby adopting a configuration which facilitates assembly and maintenance work.

In addition, in the scroll compressor 100 according to the present embodiment, the preload bolt 30B can be exposed from the second through-hole 28 by detaching the sealing bolt 29. The scroll compressor 100 according to the present embodiment can weaken the pressurizing on the angular bearing 23 and 24 by adjusting the fastening degree of the exposed preload bolt 30B, thereby adopting a configuration in which the compression unit 20 can be easily disassembled.

Second Embodiment

Figure 6A:
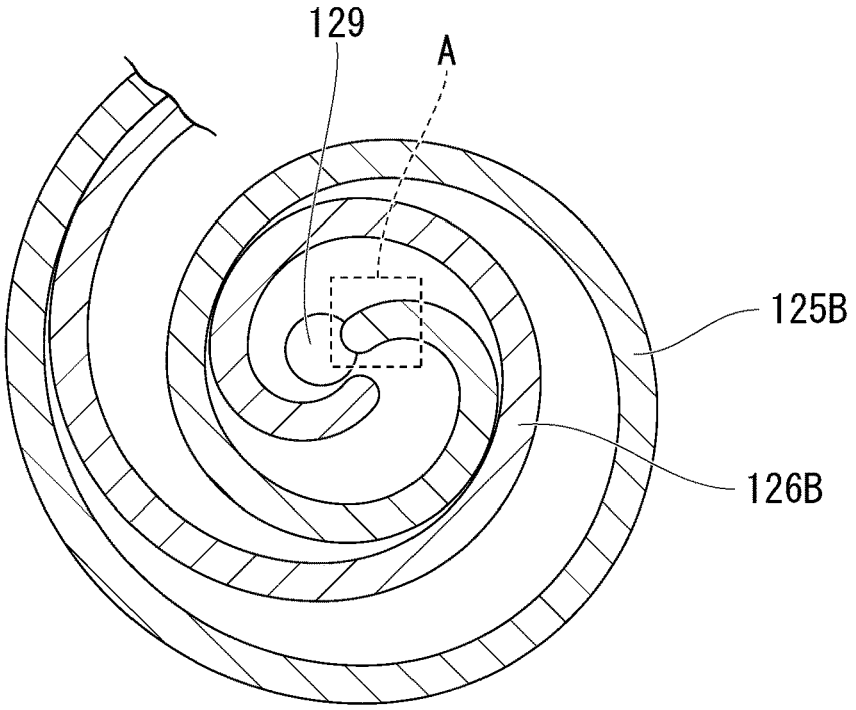
FIG. 6A is a top view of a fixed scroll and a movable scroll which configure a scroll compressor according to a second embodiment of the present invention.
Figure 6B:
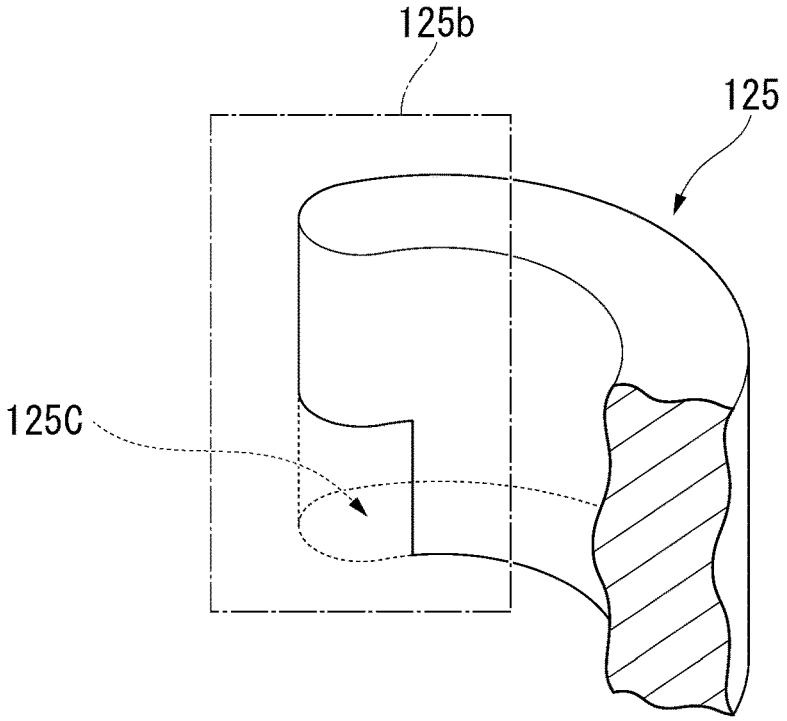
FIG. 6B is an enlarged view illustrating a structure of a fixed scroll 125 located in a region A in FIG. 6A.

FIG. 6A is a plan view (top view) schematically illustrating only a wrap structure out of a fixed scroll 125 and a movable scroll 126 which configure a scroll compressor according to a second embodiment of the present invention. FIG. 6B is an enlarged view illustrating a structure of a wrap 125B of the fixed scroll located in a region A in FIG. 6A.

The wrap 125B of the fixed scroll has a cutout portion 125C which is as large as a protruding portion of a fitted sealing bolt 129 on a side facing an end plate 126A of the movable scroll in an end portion 125*b* located the center of the whole wrap. The configuration of the scroll compressor other than the wrap 125B is the same as the configuration of the scroll compressor 100 according to the first embodiment.

In the fixed scroll used in the related art, the spiral structure of the wrap extends to the central position. As described above, in the scroll compressor 100 according to the first embodiment, the sealing bolt 29 is fitted at the central position overlapping the preload bolt. Therefore, in a case where a portion of the sealing bolt 29 protrudes from the main surface of the end plate 26A, it is difficult to use the fixed scroll having the wrap spiral structure extending to the position (center) of the protruding portion.

In contrast, the fixed scroll according to the present embodiment has a structure in which a portion overlapping the protruding portion of the sealing bolt 129 is cut out. Accordingly, the protruding portion of the sealing bolt 129 is accommodated in the cutout portion 125C. Therefore, according to the present embodiment, it is possible to use the fixed scroll in which the wrap spiral structure extends to the central position. As a result, compression can be sufficiently performed as much as the lengthened wrap.

Third Embodiment

In a scroll compressor according to a third embodiment, the fixed scroll and the movable scroll respectively have two pairs of wraps. In this case, a position which does not overlap the wrap of the fixed scroll is present on a mutually facing surface. An end plate of the movable scroll has a third through-hole at the position. A sealing bolt is fitted into the third through-hole. The configuration of the scroll compressor other than the fixed scroll and the movable scroll is the same as the configuration of the scroll compressor 100 according to the first embodiment. According to the configuration of the present embodiment, even in a case where a portion of the sealing bolt protrudes from the main surface of the end plate, the wrap spiral structure can be sufficiently lengthened. Therefore, the compression can be sufficiently performed that much.

INDUSTRIAL APPLICABILITY

According to the above-described scroll compressor, when the scroll compressor is operated, the scroll can be prevented from floating in the direction of the main shaft and being separated from the angular bearing.

REFERENCE SIGNS LIST

100, 200: scroll compressor
10: housing
10A: front housing
10B: rear housing
11: introduction port
12: discharge port
20: compression unit
21: main shaft
21*a*: end portion of main shaft
22: drive bush
23, 24: angular bearing
25, 125: fixed scroll
25A, 26A: end plate
25B, 26B: wrap
25*a*: through-hole
25*b*: reed valve
125C: cutout portion
26, 126: movable scroll
26C: boss portion
26*a*: bottom surface
26*b*: recess portion
27: balance weight
28: second through-hole
29, 129: sealing bolt
30: preload application unit
30A: preload metal fitting
30B: preload bolt
30*a*: flat plate-shaped portion
30*b*: projection-shaped portion
31: first through-hole
R: axis

What is claimed is:

1. A scroll compressor comprising:

a main shaft configured to be rotated around an axis;

a drive bush disposed in one end portion in an axial direction of the main shaft, and configured to be eccentrically rotated in accordance with rotation of the main shaft;

a pair of angular bearings arranged back-to-back, and respectively clearance-fitted to an outside of the drive bush;

a compression unit having a fixed scroll, a movable scroll, and boss portion which protrudes from an end plate of the movable scroll, the pair of angular bearings being interference-fitted to an inner peripheral surface of the boss portion; and a preload application unit configured to apply a preload to the pair of angular bearings in a direction in which the angular bearings are configured to move toward each other, wherein:

the preload application unit has a preload metal fitting which is clearance-fitted to an inside of a first of the pair of angular bearings and has a through-hole at a position overlapping the drive bush, and a preload bolt which is fitted into the through-hole; and a side wall of the drive bush has a protruding portion which supports a second of the pair of angular bearings.

2. The scroll compressor according to claim 1, wherein the through-hole is a first through-hole, wherein the end plate of the movable scroll has a second through-hole at a position overlapping the first through-hole, and a sealing bolt is fitted into the second through-hole, and wherein a wrap of the fixed scroll has a cutout portion which is as large as a protruding portion of the sealing bolt, on a side facing the end plate of the movable scroll in an end portion located at a center of the wrap of the fixed scroll.

3. A method for producing the scroll compressor according to claim 2, the method sequentially comprising:

clearance-fitting the preload application unit to the inside of the first of the pair of angular bearings;

interference-fitting the first of the pair of angular bearings into the boss portion;

interference-fitting the second of the pair of angular bearings to a position closer to an opening end of the boss portion than the first of the pair of angular bearings, inside the boss portion; and clearance-fitting the drive bush to the inside of the first of the pair of angular bearings and the second of the pair of angular bearings.

4. The scroll compressor according to claim 1, wherein the through-hole is a first through-hole, wherein each of the fixed scroll and the movable scroll has a pair of wraps, and wherein the end plate of the movable scroll has a second through-hole at a position which does not overlap the pair of wraps of the fixed scroll, and a sealing bolt is fitted into the second through-hole.

5. A method for producing the scroll compressor according to claim 4, the method sequentially comprising:

clearance-fitting the preload application unit to the inside of the first of the pair of angular bearings;

interference-fitting the first of the pair of angular bearings into the boss portion;

interference-fitting the second of the pair of angular bearings to a position closer to an opening end of the boss portion than the first of the pair of angular bearings, inside the boss portion; and clearance-fitting the drive bush to the inside of the first of the pair of angular bearings and the second of the pair of angular bearings.

6. A method for producing the scroll compressor according to claim 1, the method sequentially comprising:

clearance-fitting the preload application unit to the inside of the first of the pair of angular bearings;

interference-fitting the first of the pair of angular bearings into the boss portion;

interference-fitting the second of the pair of angular bearings to a position closer to an opening end of the boss portion than the first of the pair of angular bearings, inside the boss portion; and clearance-fitting the drive bush to the inside of the first of the pair of angular bearings and the second of the pair of angular bearings.

* * * * *